United States Patent [19]

Smith

[11] 4,253,044

[45] Feb. 24, 1981

[54] GAS DISCHARGE DISPLAY PANEL, DISPLAY APPARATUS COMPRISING THE PANEL AND METHOD OF OPERATING THE DISPLAY APPARATUS

[75] Inventor: James Smith, Horley, England

[73] Assignee: U.S. Philips Corporation, New York, N.Y.

[21] Appl. No.: 2,418

[22] Filed: Jan. 10, 1979

[30] Foreign Application Priority Data

Jan. 17, 1978 [GB] United Kingdom ..... 01812/78

[51] Int. Cl.[3] ..... H05B 37/00; H05B 39/00; H05B 41/00

[52] U.S. Cl. ..... 315/169.4; 315/169.2; 340/713; 340/714; 340/768

[58] Field of Search ..... 315/169.2, 169.4, 150; 340/713, 714, 768

[56] References Cited

U.S. PATENT DOCUMENTS

| | | | |
|---|---|---|---|
| 3,531,685 | 9/1970 | Holz | 315/169.4 |
| 3,720,919 | 3/1973 | Lamoreux | 315/169.4 |
| 3,766,420 | 10/1973 | Ogle et al. | 313/484 |
| 3,868,543 | 2/1975 | Holz et al. | 315/169.4 |
| 3,942,060 | 3/1976 | Harvey | 313/188 |
| 3,944,875 | 3/1976 | Owaki | 315/169 TV |
| 3,952,230 | 4/1976 | Sakai | 313/217 |
| 4,147,960 | 4/1979 | Andoh et al. | 340/769 |

FOREIGN PATENT DOCUMENTS

| | | |
|---|---|---|
| 1317221 | 5/1973 | United Kingdom . |
| 1337719 | 11/1973 | United Kingdom . |
| 1393864 | 5/1975 | United Kingdom . |
| 1481941 | 8/1977 | United Kingdom . |

OTHER PUBLICATIONS

Slottow, *Plasma Displays,* IEEE Transactions on Electron Devices, vol. ED-23, No. 7, Jul. 1976, pp. 760-761.

Lamoureux, *Auto Pilot,* IBM Tech. Disclosure Bul., vol. 15, No. 8, Jan. 1973, pp. 2514-2515.

*Primary Examiner*—Alfred E. Smith
*Assistant Examiner*—Thomas P. O'Hare
*Attorney, Agent, or Firm*—Marc D. Schechter

[57] ABSTRACT

A gas discharge display apparatus including a gas discharge display panel comprising a plurality of cells arranged in a column/row matrix. Cathodes are connected to the rows and anodes to the columns of the matrix. The cells are arranged in repeating groups each comprising at least two columns. Corresponding cells in each group are primed contemporaneously in a desired sequence whereby the last cell in the sequence to be primed is adjacent the first cell in the sequence to be scanned. In priming the cells each cell is discharged at a low level. Various types of priming loop sequences are disclosed.

16 Claims, 23 Drawing Figures

4a

4b

GAS DISCHARGE DISPLAY PANEL, DISPLAY APPARATUS COMPRISING THE PANEL AND METHOD OF OPERATING THE DISPLAY APPARATUS

BACKGROUND OF THE INVENTION

The present invention relates to a gas discharge display panel, to a display apparatus including the panel and to methods of priming or scanning such panels.

A simple form of a gas discharge display panel comprises a two dimensional matrix of light-emitting elements such as glow discharge cells. The elements are connected between conductors at respective cross-points formed by two groups of coordinate conductors. Each of these elements can be illuminated selectively by simultaneously applying suitable energizing signals to the two conductors, one in each group, between which the element is connected, by an addressing circuit arrangement of a display apparatus.

In the interests of clarity, the words "row" and "column" will be used to distinguish between the coordinate lines of light emitting elements which form the two-dimensional matrix of a gas discharge display. The coordinate lines may extend at any desired angle, for example 90°, to each other. Thus either of the two groups of coordinate lines of elements can be termed "row" elements with the elements of the other group being termed "column" elements. The two groups of coordinate conductors which form the cross-points will be referred to, correspondingly, as "row" conductors or electrodes and "column" conductors or electrodes.

When using gas discharge display panels for displaying alphanumeric characters it is important that the cells break-down and luminesce at the desired time, otherwise the displayed information will be incorrect. With a simple type of panel it has been found that reliable breakdown of the cells cannot be ensured. Consequently refinements have been evolved to overcome this problem.

In order to appreciate these refinements it is necessary to understand the operation of a panel and the cells thereof.

For a satisfactory display using a recurrent scanning cycle mode of operation a field rate of at least 50 Hz is desirable in order to prevent flicker, that is, the addressed cells are pulsed 50 times per second. For each field scan, the actual period of energization of a cell depends on factors such as the number of cells on a panel and the way that they are pulsed or scanned. Thus, for a 200×200 element matrix scanned row-by-row, a row rate of 50×200=10 KHz is necessary. This means that the row dwell time is 100 μS during which each element which is to be energized in a row should be held energized for as long a time as possible, during the 100 μS in order to achieve maximum brightness. However, in the case of a glow discharge cell, at least 10 μS of the row dwell time is taken up by an inherent delay which occurs before the discharge of an energised cell will ignite; and of the remaining 90 μS during which the cell could be held energised, some of this 90 μS is required for filling a column register in dependence on the coded electrical signals for the selective addressing of the cell columns. In order to keep the column addressing time at a maximum, the column register fill time may be 10 μS, for example so that the actual column addressing time is 90 μS. This means that the "on time" of the cells is 80 μS due to their inherent delay.

This inherent delay is the result of two factors: a statistical lag controlled by the time that elapses before suitable initiatory ionization is produced in the cell by agencies internal or external to the panel, and a formative delay controlled by the gas discharge processes that must occur before weak but sufficient initiating ionization is amplified sufficiently to produce breakdown and formation of the discharge.

The formative delay is controlled by the nature of the gas, the electrode geometry and the voltage that is supplied to the cell. It can also be affected by the level of the initiating ionization in the cell. Normally delays caused by formative lag can be arranged not to be a problem for cyclic panel operation. However, statistical delays can be long, seriously affecting panel operation. The problem becomes more serious as the number n of row electrodes being cycled increases because all n electrodes must be scanned, i.e. pulsed, in less than 0.02/n sec. The total lag can be a significant fraction of this value and the cells will have variable discharge duration which can seriously affect the display appearance and brightness.

One refinement to a simple panel for improving the reliability of cell-breakdown and reducing the effect of statistical lag is to arrange for a small amount of ionization to be present in each cell either all the time the display system is being operated or just before the cell is to be broken down and a discharge established. If the ionization level is increased further, the formative lag can be reduced. In the case of the simple cyclic panel, the production of this small amount of ionization to each cell, which is referred to as "priming" the cell, is achieved in a variety of ways. The panel can be designed to have "keep-alive" cells, that is cells which pass a discharge for the whole time the panel is being operated, located around the perimeter of the display. Alternatively, these perimeter cells can be switched on once per cycle as part of the cyclic addressing system. These methods give a "picture-frame" effect that can be visible to the viewer or obscured by suitable opaque barriers, either internal or external to the panel. These methods become less effective as panel size increases because the distance from perimeter to the cells in the center of the panel increases.

In some commercially available panels, discharges are formed in cells which are not display cells but which are cells auxiliary to the display. These can be referred to as "priming or scanning cells" and can be located either behind the display cells and communicating with the display cells via small holes in the cathode common to both cells as disclosed in British Pat. Specification No. 1,317,221, and U.S. Pat. No. 3,766,420, or to one side of the display cells and in the same plane as the display cells, communicating with the display cells via apertures in the cell wall structure as disclosed in British Pat. Specification No. 1,481,941. These auxiliary cells are scanned in sequence along the cathode or column electrodes in the order first cathode, second cathode . . . last cathode and then reset to commence at the first cathode again. These priming discharges may or may not be visible to the viewer as a background glow affecting the contrast of the information being displayed.

The cathode-to-cathode scanning technique used gives rise to a limitation on the maximum number of columns of cells which can be provided in a single panel if flicker effects are to be avoided. For a field scan frequency of 50 Hz and a cathode dwell time of 100 μS, the theoretical maximum number of columns of cells is 200.

This limitation is of particular importance in practical applications such as word processing, that is typing where the characters being typed are being stored on for example a floppy magnetic disc, magnetic tape or paper tape to be read by a computer, where the typist wants a temporary record of what has just been typed. For this purpose the display panel must be able to display at least 4 lines of 80 characters, both upper and lower case. For this purpose 480 columns of 48 cells are necessary, or 560 columns in the case of 2 blank spaces between characters.

U.S. Pat. No. 3,942,060 discloses a double layer panel which is divided internally into two portions, each portion having 200 columns of cells and its own display anode and cathode electrodes. The scanning electrodes of each portion are energized by respective drivers. Such a panel is structurally complicated.

SUMMARY OF THE INVENTION

Accordingly it is desired to be able to provide a display suitable for word processing in the form of a single panel of a relatively simple construction.

According to a first aspect of the present invention there is provided a gas discharge display panel comprising a plurality of cathode electrodes, each aligned with a respective row of cells, a plurality of priming electrodes, each being aligned with a respective column of cells, and a plurality of display anodes, each disposed between columns of cells. The gas discharge cells are arranged in repeating groups, each of these groups comprising at least two columns of cells. The display anodes within each group are electrically connected together to a respective single anode input for each group. According to a second aspect of the invention a display apparatus including a gas discharge display panel also comprises a source of priming pulses, a source of cathode pulses and means for controlling the sequence of application of the priming and cathode pulses so that the cells of each group are primed contemporaneously in a desired sequence. By means of the panel according to the invention, various priming sequences are possible in which each cell is primed by a previous discharge in the sequence. These sequences may be open loop or closed loop.

In the case of closed loop priming of cells, a group comprising a single column of cells can be primed by applying pulses to the column electrode and switching the cathode pulses applied to the row electrodes so that priming takes place cell-by-cell down and up the column for as long as the display is energized. In the case of two or more columns in a group, the closed loop priming sequence takes various modes depending in part on whether there are an odd or even number of columns of cells in a group. Whatever the exact mode, reliable priming of the whole of a panel is achieved regardless of the panel size and message being displayed. Only one initiating priming cell or keep-alive cell is required. Provided the one keep-alive cell is suitably positioned, the loop need not be closed because the last cell in one group will prime the first cell in the next group. However, by closing the loop, the priming of the panel is made more reliable.

Since all the cells, whether "on" or "off", are discharged periodically the cells are regularly conditioned. This helps to assure that the characteristics of all cells will be more nearly equal, thus reducing the spread of the characteristic values and thereby enabling the addressing circuitry to be made more reliable as it can be designed to operate cells having the reduced spread of characteristics.

To display the required message, the priming discharges may be increased in brightness by a display signal input at the appropriate time.

BRIEF DESCRIPTION OF THE DRAWINGS

The present invention will now be described, by way of example, with reference to the accompanying drawings.

DESCRIPTION OF THE PREFERRED EMBODIMENTS

Figure 1:
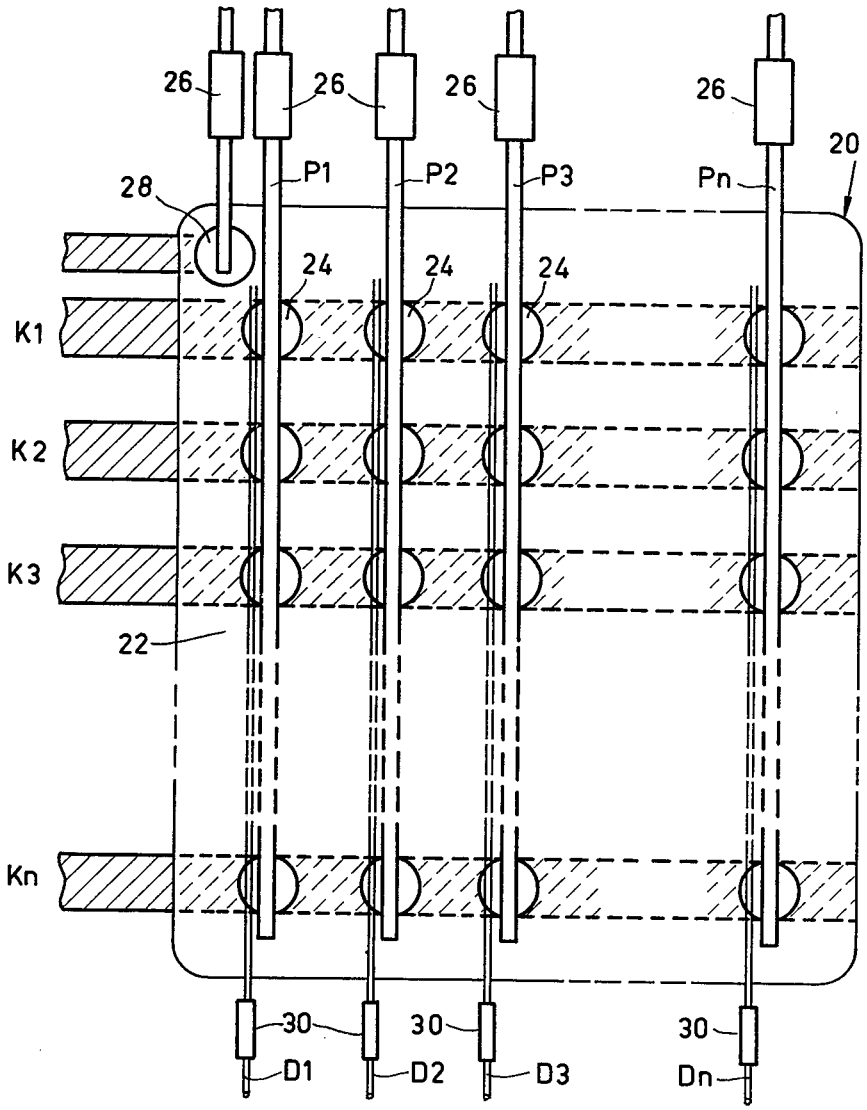
FIG. 1 is a diagrammatic view of a portion of one embodiment of a gas discharge display panel.

FIG. 1 shows diagrammatically a portion of a single layer gas discharge display panel 20. The panel 20 is of sandwich construction comprising an apertured plate 22 having a plurality of apertures 24 which are arranged in a row-column matrix and which constitute the cells of the panel 20. The plate 22 is of an electrically insulating material or may comprise an electrically conductive material with an insulating surface including the interior surface of each aperture. The apertures 24 contain a gas such as a mixture of argon and neon preferably with the addition of mercury under sub-atmospheric pressure, for example 400 Torr. Cover plates or substrates (not shown), are arranged on either side of the plate 22. At least one of these plates is optically transparent and is spaced from the plate 22 in order to provide communication for free ions between adjacent cells. Spaced apart cathode electrodes K1, K2, K3 . . . Kn are applied to one of the cover plates or substrates which abuts the plate 22. The cathode electrodes K1, K2, K3 comprise horizontal (row) electrodes aligned with respective rows of apertures 24. Substantially transparent, thin film priming or scanning electrodes P1, P2, P3 . . . Pn and thin film display anode electrodes D1, D2, D3 . . . Dn of tin/indium oxides are provided on the other cover plate, preferably the transparent one. In this embodiment the priming electrodes and display anodes extend orthogonally to cathode electrodes and intersect the same at the apertures 24. A keep-alive cell 28 with its respective cathode and anode electrodes is provided at a convenient point on the perimeter of the panel 20. Resistors 26 having a value of 1 MΩ are connected to each priming electrode and resistors 30 having a value of 56 KΩ are connected to each display anode. Each priming electrode and display anode is associated with a particular column of cells. For convenience each column will be identified using the reference applied to the priming electrode.

PRIMING SEQUENCES

One way of operating the panel 20, is to energize each priming electrode in turn and scan cell-by-cell down the column of cells associated with the priming electrode by energizing each cathode in turn. When priming a cell it is broken down at a low discharge current so that it emits very little light and releases free ions. In order to display information the particular display anode is energized at the same time that the cell is primed and in so doing the discharge current is increased with a consequent increase in light output. Having regard to the earlier discussion on avoiding flicker using a dwell time of 100 μS, the theoretical maximum number of cells which can primed on a simple cell-by-cell basis is 200. Obviously this is not practical for large panels.

One method priming of the cells of a gas discharge panel may be achieved by what is referred to here as closed-loop priming or scanning. The simplest mode of closed-loop priming will now be described with reference to FIG. 1. In this embodiment each column of cells comprises its own closed loop with its own priming electrode and display anode. During priming each priming electrode P1 . . . Pn is energized and cathode pulses are applied to the electrodes in the sequence K1, K2, K3 . . . Kn, but instead of resetting to K1, the order is reversed so that Kn is pulsed again, then Kn-1 back to K3, K2 and K1 where the cycle begins again. The priming electrode and cathode voltages are selected so that each cell in the column is broken down in turn and a small discharge current is passed. The effect of this is that the whole column appears to have a permanent low brightness and this represents the cells in their "off" state. In order to turn a particular cell in the column "on" it is necessary to reduce the anode impedance by energizing the associated display anode D1 . . . Dn for the period that the cell's cathode is receiving its negative pulse during the closed loop priming cycle, that is when going down the column as well as back up again. By reducing the anode impedance at the relevant intervals, the discharge current is increased and the light output from the cell increases significantly.

Once a closed loop sequence of priming is established, it is maintained until the display is switched-off. Moreover, a closed loop sequence established in one column will prime its neighboring columns and, by a "ripple-through" effect, the whole panel is triggered into contemporaneous individual closed-loop operations. Thus the provision of one keep-alive cell 28 is sufficient to establish the panel in this condition. Further, satisfactory priming is produced in every cell, independent of panel size, and in the worst-case situation of only one cell to be turned "on" in the center of a large panel, it can be displayed reliably.

The closed-loop priming principle described can be extended to cover groups of either odd or even numbers of columns of cells.

Figure 2:
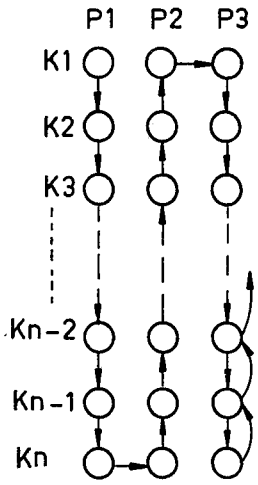
FIGS. 2, 3, 4(*a*), (*b*) and (*c*) show diagrammatically various different sequences of closed loop priming.

FIG. 2 illustrates a simple extension of the closed loop priming of FIG. 1 to a group of three columns of cells having priming electrodes P1, P2 and P3. The priming sequence is down the column of P1, up P2, down P3, back up P3, down P2, and up P1. Thus the scan order is P1 K1; P1 K2 . . . P1 Kn-1; P1 Kn; P2 Kn; P2 Kn-1 . . . P2 K2; P2 K1; P3 K1 . . . P3 Kn-1; P3 Kn; P3 Kn; P3 Kn-1; and so on to P1, K2; P1 K1; the sequence repeating thereafter. Provided that the pulse duration is adjusted to counter flicker this priming sequence can be extended to cover a greater odd number of columns, for example 5 columns which is particularly useful in alpha-numeric display applications requiring 5 columns per character.

Figure 3:
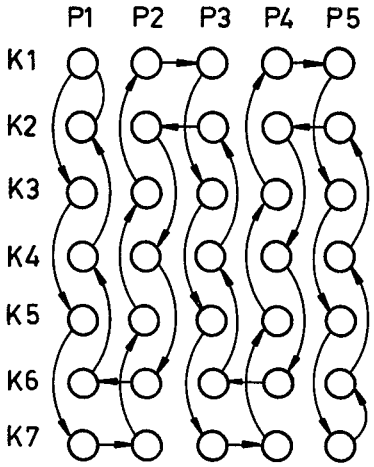

The problem of flicker can be largely offset, for example when displaying alpha-numeric characters using a 5×7 group of gas discharge cells, by using a sequence in which a cell is not primed by its immediate neighbor but by a cell somewhat further away. In determining the exact sequence, it must be ensured that the next cell in the sequence is adequately primed to avoid the risk of a non-addressed cell breaking down rather than the addressed one. FIG. 3 shows one of many possible sequences of priming a 5×7 group of cells in this way. Commencing at P1 K1, the closed loop proceeds to P1 K3; P1 K5; P1 K7; P2 k7 . . . P2 K1; P3 K1 . . . P5 K6; P5 K4; P5 K2; P4 K2; P4 K4; P4 K6; P3 K6 . . . P3 K2; P2 K2 . . . P2 K6; P1 K6 . . . P1 K2; P1 K1 and the cycle repeats again.

If the arrangement of FIG. 3 has an even number of rows, the alternate cell priming sequence can be carried out in substantially the same manner.

Figure 4:
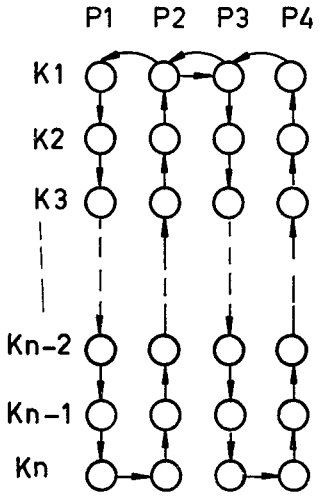
Figure 4:
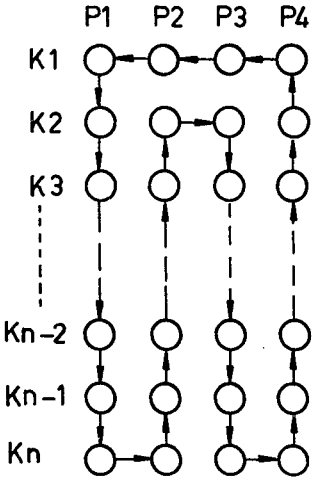
Figure 4C:
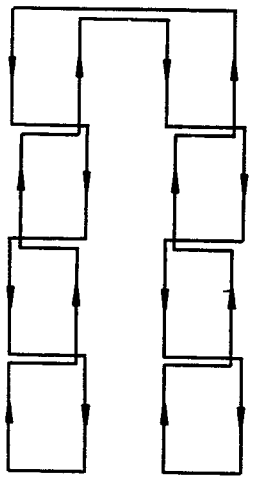

In the case of groups of even numbers of columns of cells, the loop can be closed without reversing the scanning order even when the priming sequence is to nearest neighbor cells. FIG. 4(*a*) illustrates a priming sequence for a group of 4 columns which sequence beginning at P1 K1 goes down to P1 Kn, across to P2 Kn and up to P2 K1, across to P3 K1, and down to P3 Kn, across to P4 Kn and up to P4 K1, and then back to P1 K1 by discharging P3 K1 and then P2 K1. One effect of discharging P3 K1 and P2 K1 twice is that they will appear brighter than the other cells. If desired the sequence may be modified so that after P4 K2 has been pulsed, P4 K1; P3 K1; P2 K1 and P1 K1 are all pulsed together.

FIG. 4(*b*) illustrates a priming sequence for a group of 4 columns in which each cell is discharged once in each cycle. The priming sequence of FIG. 4*b* differs from that of FIG. 4*a* by the feature of the priming sequence going up P2 as far as P2 K2 then across to P3 K2 and down to P3 Kn and so on as in FIG. 4*a*.

Other scan sequences are possible in which interlacing of columns is made by transferring to another column before reaching the bottom of the panel for example pattern 4(*c*). Such patterns can give reduction of drivers and reduction of flicker effects.

Figure 5:
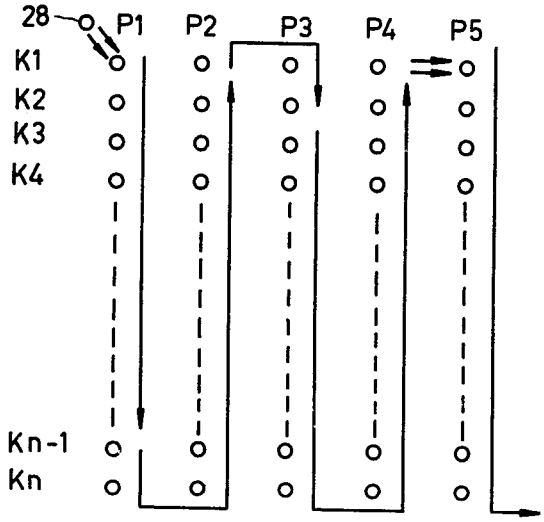
FIGS. 5 and 6 show diagrammatically two open loop priming sequences.

FIG. 5 illustrates a non-closed loop method of priming groups of cells by a "ripple-through" effect. During the first scan field a first group of 4 columns of cells is primed starting at P1 K1 and following the sequence of FIG. 4(*a*) until P4 K1. However, instead closing the loop as in FIG. 4(*a*), the cell P4 K1 provides free ions to facilitate the priming of P5 K1. The keep alive cell 28 provides free ions to P1 K1. At the beginning of the next scan P1 and P5 are energized and the cathodes are energized in turn. By this technique the two groups of cells are primed simultaneously. At the end of the second scan P4 K1 again provides free ions to P5 K1 while P8 K1 (not shown) provides free ions to P9 K1 (not shown). The number of groups of cells being primed simultaneously increases by one on each field scan until all the groups of cells are being primed.

Figure 6:
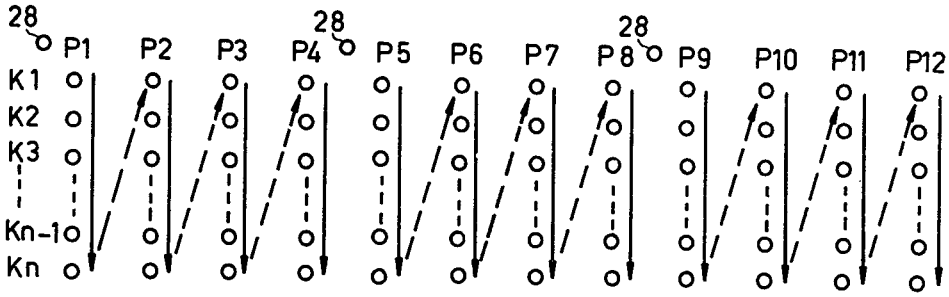

Another non-closed loop system is shown in FIG. 6 wherein each group of cells has its own keep alive cell 28. The priming sequence commences at P1 K1, P5 K1, P9 K1 and so on, free ions having been provided by the adjacent keep alive cell 28. The priming proceeds cell-by-cell down each column of cells associated with P1, P5, and P9 and so on. Instead of travelling up the next column as in FIG. 5, the priming continues from the top of the next columns P2, P6, P10 and proceeds down cell-by-cell. The free ions provided by the keep alive cells 28 facilitate the priming of the top cell in each column.

Figure 7:
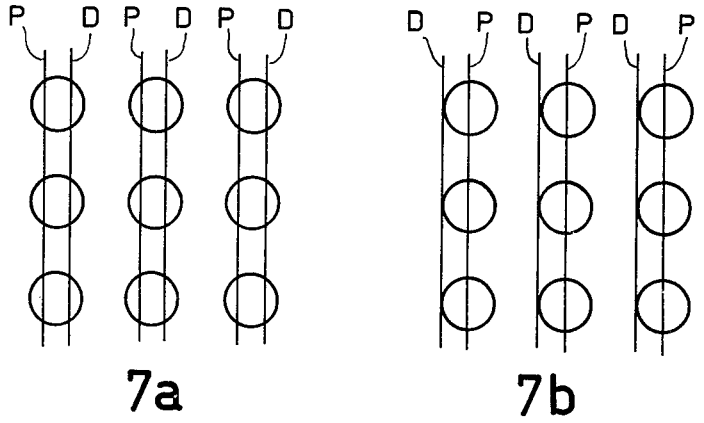
FIGS. 7(*a*) and (*b*) show schematically how separate display and priming electrodes may be arranged in a gas discharge display panel.

In making the gas discharge display panel according to the present invention, the exact location of the priming electrodes and display anodes in relation to the center line passing through each column of cells may vary. FIG. 7(*a*) shows the priming electrodes P and display anodes D may be arranged symmetrically relative to a center line passing through each column of cells. FIG. 7(*b*) shows an alternative arrangement in which the priming electrodes P are arranged centrally over each column of cells and the display anodes D are offset to one side.

In order to reduce the number of external connections it is possible to arrange interconnections of certain electrodes within the panel itself as will be described with reference to FIG. 8.

Figure 8:
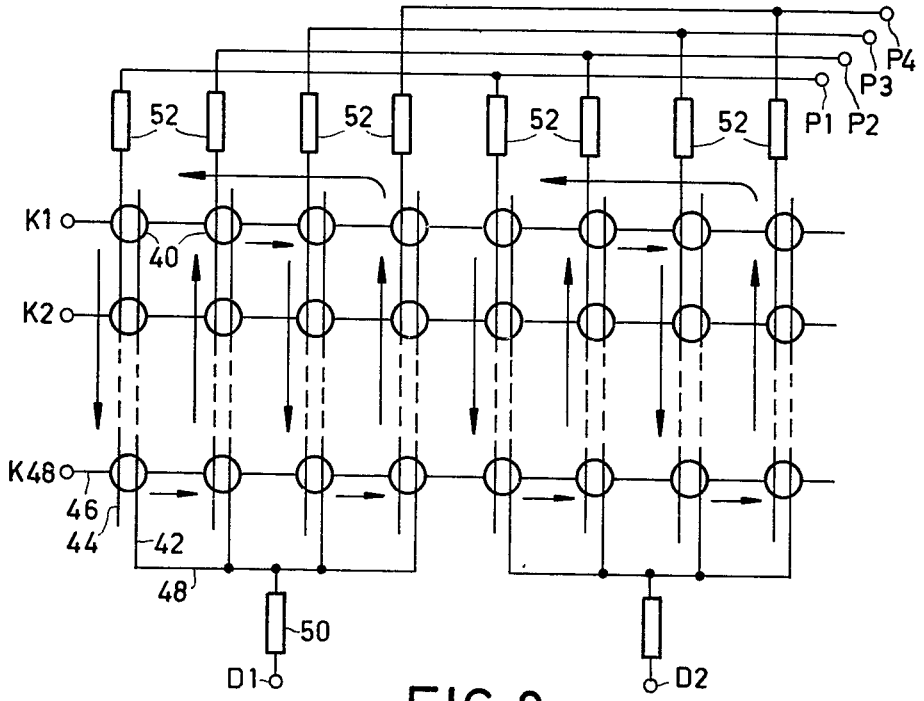
FIGS. 8 and 9 show diagrammatically portions of two gas discharge panels with separate display and priming electrodes.

In FIG. 8 the panel comprises a plurality of gas discharge cells 40 arranged in a matrix comprising for example 48 horizontal rows and 480 vertical columns. Each cell 40 has a display anode 42, a priming electrode 44 and a cathode electrode 46. The cathode electrodes 46 are arranged so that each one K1,K2 . . . K48 connects all the cells in one row. Similarly each column of cells 40 has its common display anode and priming electrode.

In order to effect closed loop priming, the columns of cells 40 are divided into groups with 4 columns per group and in the case of 480 columns of cells there are 120 groups.

The display anodes 42 of each group of cells are connected together by a common connection 48 which is connected by way of a resistance 50 of 56 K Ω to a respective display anode input D1, D2 . . . D120 (not shown). A thick-film printed resistance 52 of 1 MΩ is connected to each priming electrode. Conveniently each thick film resistance 52 is printed directly onto its associated priming electrode. The priming electrodes of the first column in each group, that is columns 1, 5, 9 and so on counting from the left in FIG. 8, are connected to a first common priming terminal P1, the second columns in each group, that is columns 2, 6, 10 and so on are connected to a second common priming terminal P2 and in a similar fashion the third columns that is columns, 3, 7, 11 and so on and the fourth columns that is columns 4, 8, 12 and so on, are connected respectively to third and fourth common priming terminals P3, P4.

By suitable addressing circuitry, corresponding cells 40 in each group are primed at the same time. Furthermore the cells in each group are primed in a closed loop as shown by the arrows. In order to do this each cell is primed by applying, in the case of the first columns, forty-eight successive 20 μS wide pulses at a frequency of 10 KHz to the terminal P1, see FIG. 11 (curve (a)). At the occurrence of the leading edge of each priming pulse the cathode electrodes K1, K2 . . . K48 are pulsed successively with 100 μS pulses. In view of the potential difference existing between say K1 and P1 for 20 μS the cell concerned builds up a charge and fires after about 16 μS. As a result the cell discharges for a short time of about 4 μS. In so doing it emits a dim light and provides a sufficient number of free ions to prime the cells on either side of it. The direction of breakdown progression is determined, however by the sequence of the cathode pulses K1, K2 . . . K48. At the foot of the first column, the cell P1, K48 (or P1 Kn) primes the cell P2, K48 (or P2 Kn) which is broken down next in sequence by pulses on P2 K48. By reversing the order of the cathode pulses compared with the first column that is, producing cathode pulses in the order K48, K47, K46 . . . K2, K1, and applying 48 pulses on P2 the priming discharges move successively up the second column. The priming discharges continue down the third column and up the fourth column. At the top of the fourth column, the priming action is transferred to the cell denoted by the intersection of K1 and P1.

Figure 11:
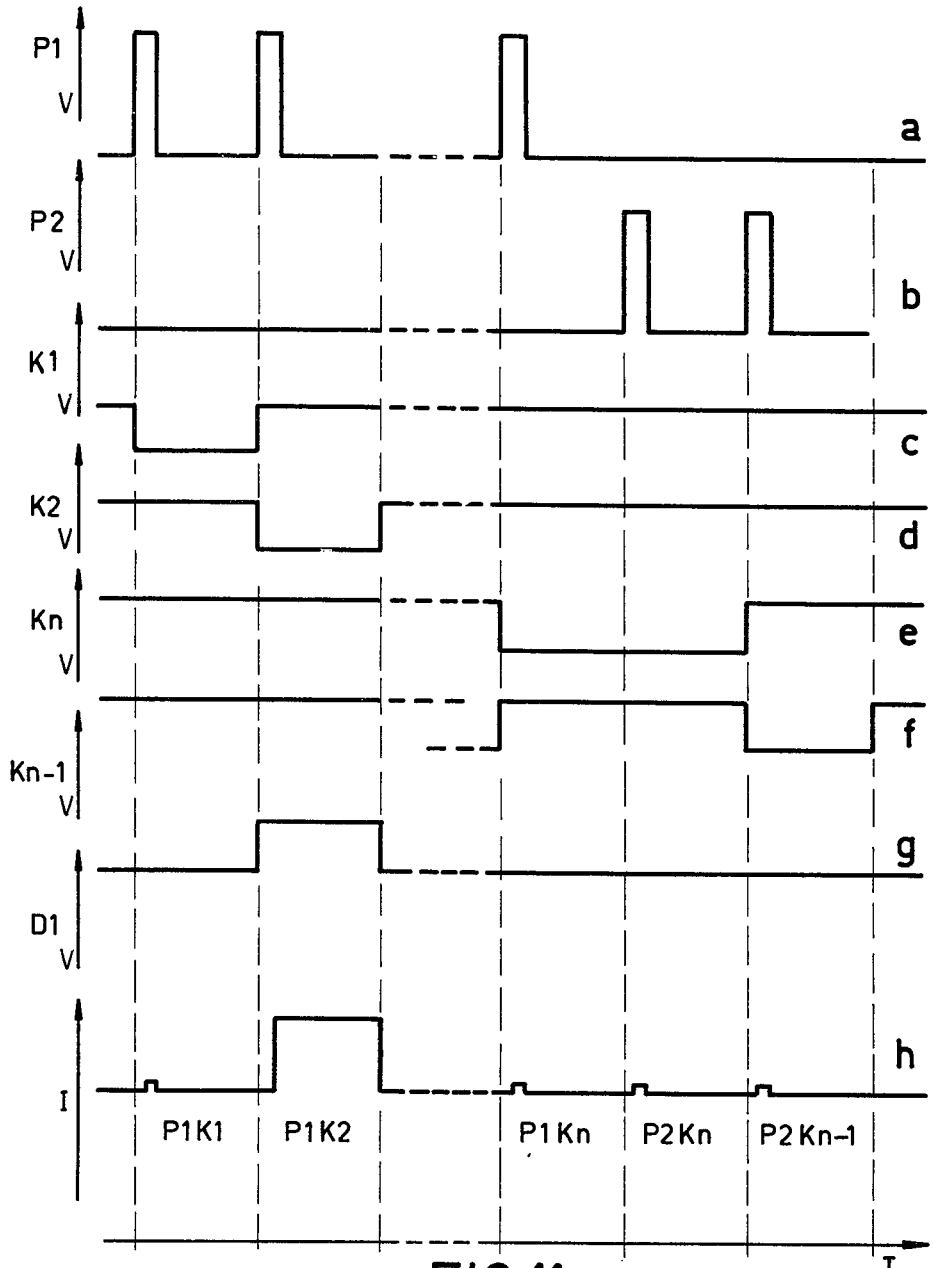
FIG. 11 comprises a series of graphs illustrating how the panels of FIGS. 8 and 9 can be primed and how an information signal can be displayed thereon.

If a particular cell 40 in a group is to be fully illuminated then a 100 μS low impedance pulse is applied to the appropriate display anode terminal D1, D2 . . . D120 (not shown) at the appropriate time in the closed loop priming cycle. FIG. 11, graph (g) shows a 100 μsec positive pulse being applied to the display anode terminal D1 at the same time that pulses are present on P1 and K2. The display anode pulse is of lower amplitude than P1 because it takes over the ionization of discharge from the priming anode which it will be recalled caused the cell to produce a dim light, and by passing a larger current for a longer time, the light emitted by the cell increases significantly to produce a contrast ratio of the order of 20:1.

In the case of the embodiment of FIG. 8, the closed loop priming of each group of cells enables the cells to be primed reliably with only one keep-alive cell (not shown) arranged on the perimeter. Further by interconnecting the priming electrodes of the groups of cells only 4 external connections P1 to P4 are required. The interconnection of the display anodes of each group only requires 120 external connections. With the addition of 48 cathode connections the total number of connections for a 480×48 panel is 172 compared with 528 for a simple panel with single anode and single cathodes.

The forming of groups of 4 columns is purely exemplary. The groups may comprise any even number of columns such as 2, 4, 6, 8. The number of external priming terminals corresponds to the number of columns in each group. The number of external cathode connections may be reduced by arranging the cathodes in repeating groups of say 12 cathodes for example as disclosed in British Pat. Specification No. 1,393,864. Apart from the first cathode K1 of the first group, all the other first cathodes, that is K13, K25 and K37 are connected jointly to a single external connection. Similarly all the second cathodes K2, K14, K26 and K38 are connected together to a second common external connection. The third to twelfth cathodes are similarly connected thereby making a total of 13 external connections. The first cathode K1 is separately connected because of the need to apply a reset signal.

PANEL CONSTRUCTION

Figure 9:
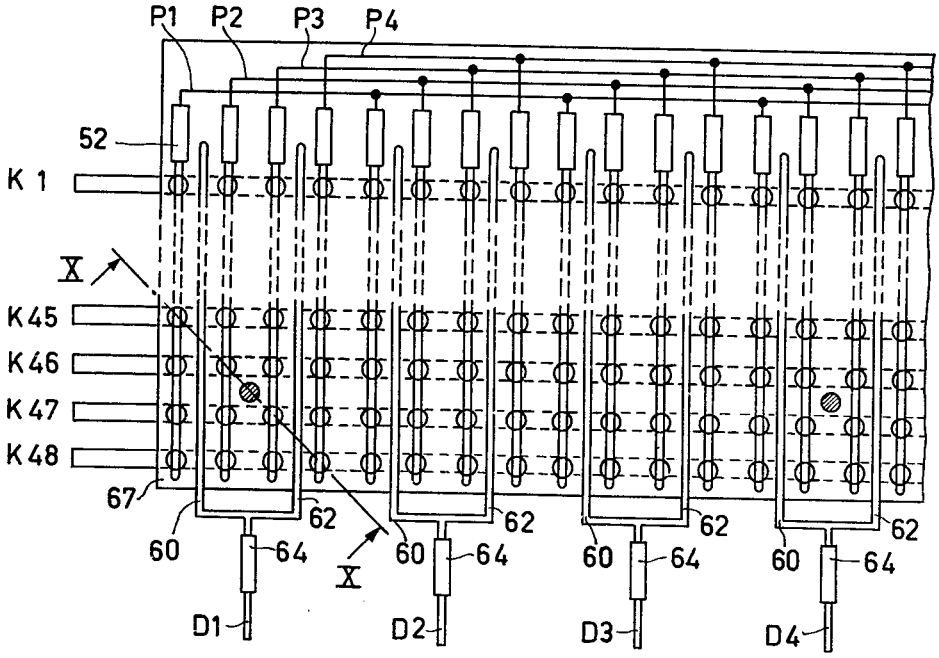

FIG. 9 shows diagrammatically an embodiment of a display panel in which the display anode electrodes are arranged so that one electrode 60 is disposed laterally between two adjacent columns of cells and a second electrode 62 is disposed laterally between two other adjacent columns of cells in the same group. The electrodes 60, 62 are connected by a common resistance 64 to an external connection D1, D2 . . . D120. The arrangement of the display anode electrodes 60, 62 simplifies the construction of the panel itself which may be fabricated wherever possible by thick film printing of the electrodes, bus rails and resistors as appropriate.

FIG. 11 shows graphs of various changes of voltages V and currents I with time T. Graphs (a) and (b) illustrate the narrow priming pulses P1 and P2, respectively. Graphs (c) to (f) illustrate the cathode pulses applied to cathodes K1, K2, Kn and Kn-1, respectively. Graph (g) shows a display pulse D1 applied at the same instant that cathode K2 has been pulsed and graph (h) shows the cell currents I.

In the case of FIGS. 8 and 9, a sequence of n (n=48) priming pulses P1 are applied to the first column of cells and at the occurrence of the leading edge of each pulse P1 a different cathode K1 to Kn is pulsed in turn. With closed loop priming, after the last pulse P1 has been applied, a sequence of priming pulses P2 is produced. In order to prime the cells of the second column in the opposite direction to the first column, the cathodes are sequenced in the reverse order. Hence in graph (e), the cathode pulse appears to be twice the width of the other pulses, in fact it is two cathode pulses in succession.

If one or more cells are to display information then a display pulse, D, is applied to each associated display anode at the instant each cell is primed. In FIG. 11 the display anode D1 is pulsed when the cell P1, K2 is primed, graph (g), and in consequence the cell breaks down fully, graph (h), and emits a high brightness.

Figure 10:
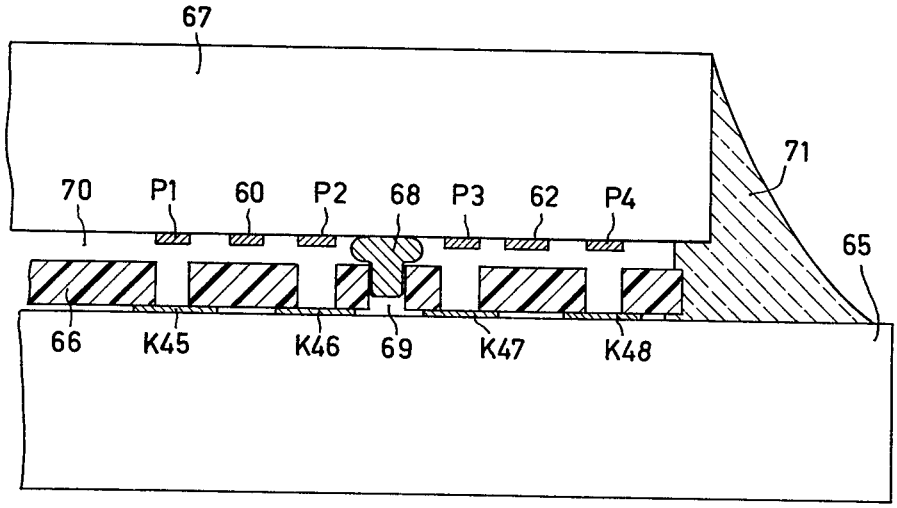
FIG. 10 is a section on the line X—X of FIG. 9.

FIG. 10 which is a section on the line X—X of FIG. 9 shows one form of panel construction in greater detail.

The panel comprises a cathode substrate 65 of an insulating material on which the cathode electrodes K1 . . . K48 are thick film printed. An apertured plate 66 is superposed on the cathode electrodes so the rows of apertures in the plate are aligned with respective cathode electrodes. The plate 66 may be of an electrically insulating material or of an electrically conductive material having an insulating surface thereover, including the surface of the apertures. An optically transparent cover plate 67 is disposed over the apertured plate 66 and is spaced therefrom by spacer buttons 68 inserted into additional apertures 69 located between the rows and columns of apertures forming the gas discharge cells. The spacer button 68 may comprise ballotini which have been softened and deformed under pressure into the apertures 69. By way of example the pitch between the apertures 69 corresponds to the distance between twelve cell forming apertures.

On the underside of the cover plate 67 transparent priming electrodes P1 to P4 of, say, tin and indium oxides are formed by thin film processes. The priming electrodes are aligned with, respectively, columns of cells. As shown clearly in FIG. 10 the thin film printed display anodes 60 and 62 are located between pairs of priming electrodes. A gas such as mixture of argon and neon preferably with mercury vapor at a sub-atmospheric pressure of 400 Torr fills the cells and a planar chamber 70 formed between the apertured plate 66 and the cover plate 67. In so doing the gas contacts all the electrodes in the panels. A glaze 71 seals the edges of the panel and prevents the loss of gas. The thickness of the apertured plate 66 may lie in the range 100 to 500 μm with a typical thickness being 200 μm. The height of the planar chamber 70, that is the distance between the plates 66 and 67 may lie in the range of 50 to 250 μm with a typical height being 100 μm. A typical diameter of a cell forming aperture is 300 μm.

Other constructional and operating characteristics of a typical panel of the type shown in FIGS. 9 and 10 are shown in Table 1:

TABLE 1

| | |
|---|---|
| Cell pitch | 0.635 mm |
| Priming electrodes, located over the centers of the cells, width | 0.150 mm |
| Display anodes, located midway between columns of cells, width | 0.150 mm |
| Priming electrode resistor 52 | 1.0 MΩ |
| Display anode resistor 64 | 56 K |
| Cathode pulse voltage | −80 volts |
| Priming electrode pulse voltage+ | +150 volts |
| Display anode pulse voltage+ | +60 volts |
| Cathode pulse duration | 100 μsec |
| Priming pulse duration | 20 μsec |
| Display anode pulse duration | 100 μsec |
| Average time delay before cell breakdown | 15 μsec |
| Luminance ratio "on":"off" | 20:1 approx. |

+ *measured from a bias voltage level.*

By providing the planar chamber 70, free ions produced by the breaking down of a cell using priming (or scanning) pulses can move in any desired direction, the actual direction of movement being determined by the pulsing of the cathodes and priming electrodes. Further the planar chamber 70 enables an increased pumping rate to be achieved when evacuating and degassing the panel. The planar chamber is also particularly useful when it is desired to add mercury vapor to the gas in the panel as the chamber can facilitate the even distribution of the vapor which is necessary in order to obtain an even light output from the panel.

The planar chamber 70 may be formed by other methods than merely inserting spacer buttons 68 into the additional apertures 69 in the plate 66. The criteria in forming the chamber 70 are that the free ions can move substantially in any direction as required in order to assist the priming of a cell but that the height of the chamber is such that the glow formed by the breakdown of one cell does not spread via the chamber 70 to the next following cell to be primed.

Figure 12:
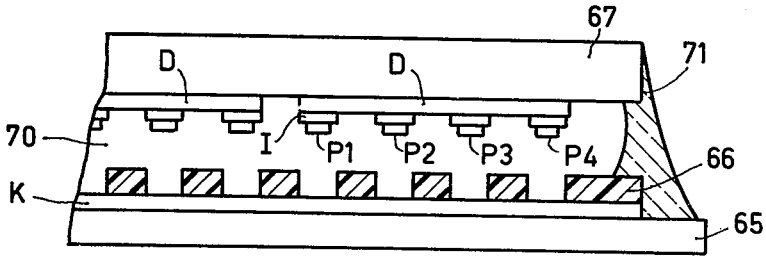
FIG. 12 shows diagrammatically a section through an alternative structure of a panel to that shown in FIG. 10.

FIG. 12 shows diagrammatically an alternative structure of a discharge panel in which the display anode D for each group of cells is a large area electrode and the priming electrodes P1 to P4 are mounted on transparent insulators I provided on the display anode D. A resistor (not shown) is connected to each display anode.

Ways of forming the chamber 70 will now be described.

Figure 13:
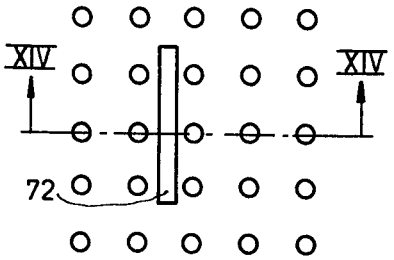
FIG. 13 is a diagrammatic plan view of a part of a display panel showing the use of a fiber to space the cover plate from the apertured plate.
Figure 14:
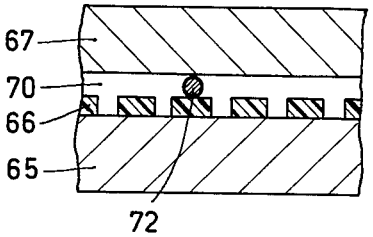
FIG. 14 is a cross-sectional view on the line XIV—XIV in FIG. 13.

FIGS. 13 and 14 show diagrammatically the provision of spacer fibers 72 at intervals between the apertured plate 66 and the cover 67. Although the fibers 72 may be held in place by friction due to pressure between the plates 66 and 67, it is desirable that some form of bonding is used to avoid the risk of displacement of the fibers 72 by jarring the panel.

Figure 15:
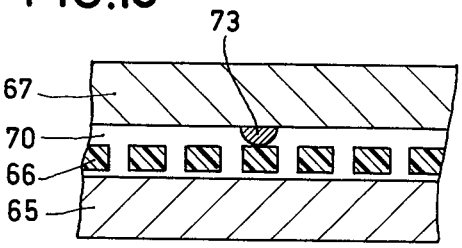
FIG. 15 is a diagrammatic cross-sectional view of a portion of a display panel showing the use of thick film printed dots to space the cover plate from the apertured plate.

FIG. 15 shows diagrammatically the forming of thick film printed glass dots 73 on the cover plate 67. The location and spacing between the dots 73 corresponds to that of the spacer buttons 68 in FIG. 10. As the dots 73 are an alternative to the buttons 68, their heights will be the same for a particular panel, and will be in the range 50 to 250 μm, typically 100 μm.

Figure 16:
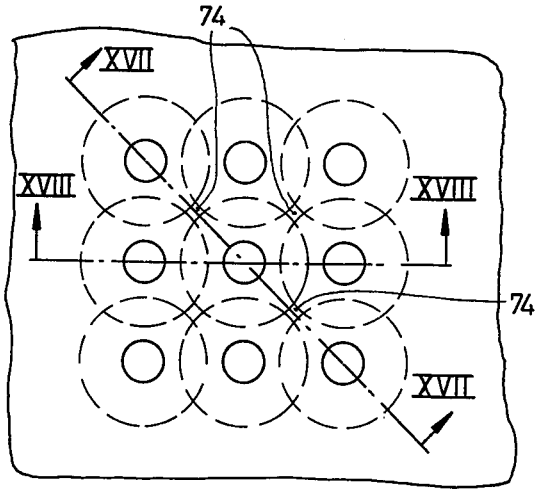
FIG. 16 is a diagrammatic plan view of a portion of a panel in which the cells are of frustoconical shape.
Figure 17:
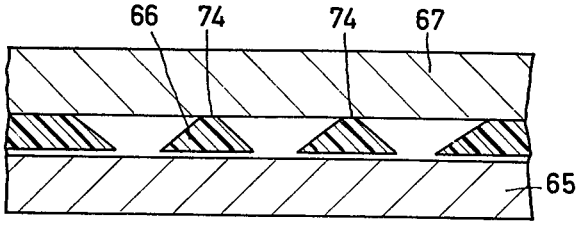
FIGS. 17 and 18 are respectively sections on the lines XVII—XVII and XVIII—XVIII of FIG. 16.
Figure 18:
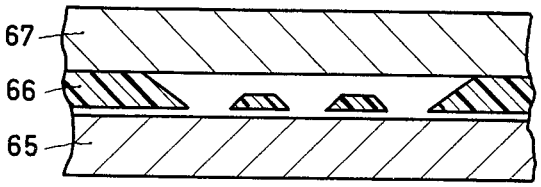

FIGS. 16 to 18 show diagrammatically a further method of forming the planar chamber. Each of the cell apertures is of frusto-conical shape and converges in a direction towards the substrate 65. The diameter of the apertures at the upper surface, that is the surface facing the cover plate, of the apertured plate 66 is such that the apertures overlap one another leaving small islands 74 of material having a height corresponding to the original thickness of the apertured plate 66. Hence a substantially planar chamber is formed which is closed at the periphery of the plate 66 and is supported at regular intervals by the islands 74. If desired the height of the chamber may be increased by providing thick film printed glass dots, such as the dots 73 in FIG. 15, at locations corresponding to some or all of the islands 74.

For the sake of clarity the cathodes, priming electrodes and display anodes have been omitted from FIGS. 13 to 18. However these electrodes can be arranged as shown in FIGS. 8, 9 or 12.

SYSTEM STRUCTURE

Figure 19:
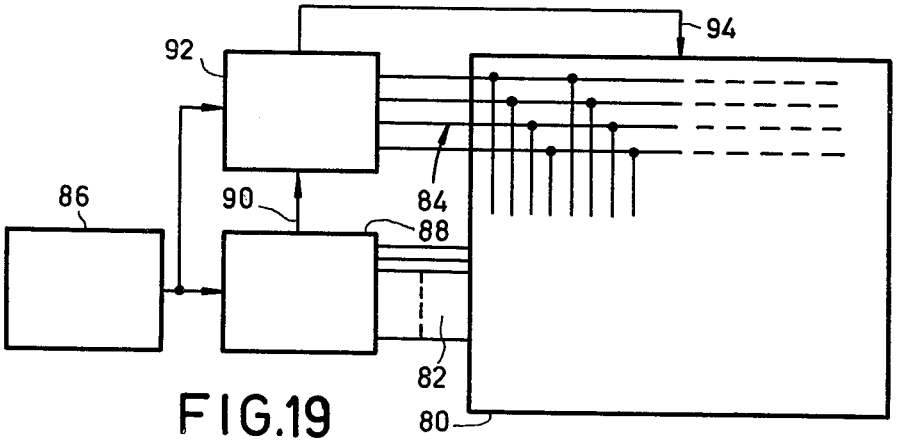
FIG. 19 is a block schematic circuit diagram of a circuit for closed loop priming of the cells of a gas discharge display panel.

FIG. 19 is a simplified block schematic diagram of one embodiment of a display panel priming circuit which can be used to provide the priming sequence disclosed in FIGS. 4(*a*), 8 and 9. For the sake of example only, it will be assumed that the display panel 80 has fifty cathode connections 82 and four priming electrode connections generally indicated as 84. The columns of cells are arranged in repeating groups of four columns and the connections 84 are connected as shown for example in FIGS. 8 and 9. In the interests of clarity the separate display anodes and their connections have not been shown, but these may be arranged as described for example with reference to FIG. 8 or 9.

The priming circuit includes a 10 KHz clock oscillator 86, the output of which is connected to a cathode scanner 88. The cathode scanner 88 which may comprise an up-down counter has an output connection coupled to the cathode connection of each row (or groups of rows) of cells. The scanner 88 has a further output connection 90 connected to a priming electrode scanner 92. The cathode scanner 88 produces an output carry pulse each time it reaches its maximum (Kn) and minimum (K1) count. In the case of the described embodiment n=50 and therefore a pulse is applied via the connection 90 to the priming electrode scanner every fiftieth clock oscillator pulse. At the receipt of each carry pulse from the cathode scanner 88, the priming electrode scanner 92 switches from one connection 84 to the next. By this technique each priming electrode connection in a group is energized for a duration corresponding to the time that the cathodes are scanned. The scanner 92 includes a flyback connection 94 for applying a flyback pulse to the priming electrodes in order to close the priming loop.

To describe the operation of this device, we begin by assuming the cathode scanner 88 is at a minimum count and the priming electrode scanner 92 is energizing the first priming electrode. On the receipt of the first fifty pulses from the oscillator 86, each cell is primed or turned-on at a low level in turn proceeding down the column from the top. On the fiftieth pulse an output is produced on the connection 90 which indexes priming electrode scanner 92 so that the second column in each group is energized, while the first column is de-energized. The cells in the second column are primed in turn from the fiftieth cell to the first cell. The priming is then transferred to the third column of each group and proceeds down the third column from the top and thereafter proceeds up the fourth column of each group until the priming reaches the topmost cell on the two hundredth pulse. The priming electrode scanner 92 applies a flyback pulse to the correction 94 which in turn applies the flyback pulse to all the priming electrode drivers either simultaneously or separately in the succession 3, 2, 1 in order to close the priming loop. During the flyback period the cathode scanner 88 pauses at the first cathode. The sequence then repeats. In the described circuit each cell is primed at least fifty times a second.

By suitably programming the priming electrode and cathode scanners any desired closed loop or non-closed loop priming sequence can be carried out.

In the case of energizing the display anodes (not shown), the feeding of data to the particular anode(s) must be selected to correspond with the currently addressed column of the display panel 80. A comparator device can be used to ensure proper synchronization.

Figure 20:
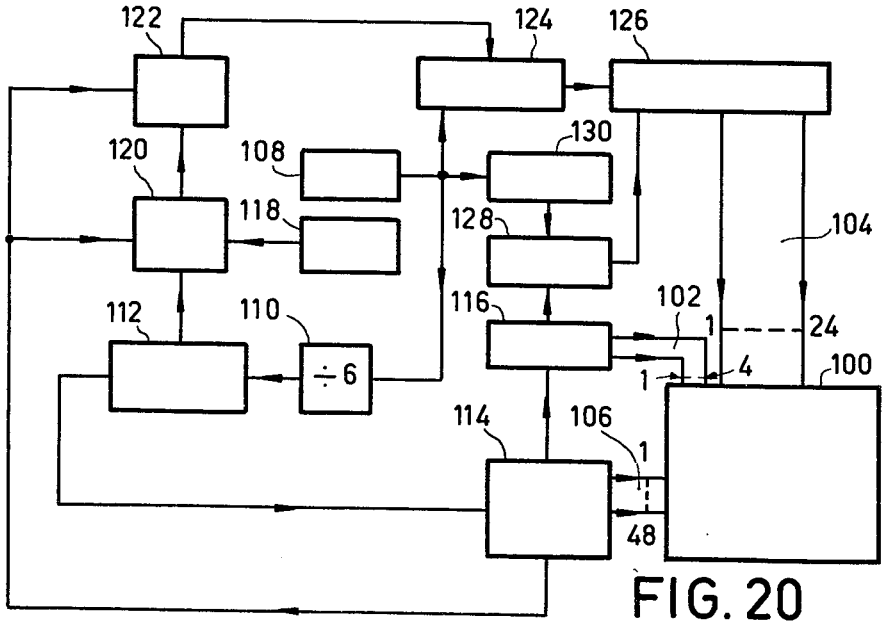
FIG. 20 is a block schematic circuit diagram of a priming and addressing circuit.

FIG. 20 is a block schematic circuit diagram of an embodiment of a priming and display circuit for a gas discharge display panel 100 of the type shown in FIG. 8 or 9.

For the sake of explanation it will be assumed that the panel 100 is a matrix comprising 96 (columns)×48 (rows) of cells. The columns of cells are grouped in fours with the priming electrode of the first column in each group being connected to one input, the priming electrodes of the second column in each group being connected to a second input and so on. For convenience the priming electrode inputs have been shown collectively as 102. Each of the twenty-four groups of columns has its own display input shown collectively as 104. The forty-eight cathode inputs are collectively referenced as 106. In order to scan all 192 cells in each group fifty times a second it is necessary to complete a scan in approximately 20 mS thereby making it necessary to apply pulses of approximately 100 μS to the cathode inputs 106.

The pulses for the cathode inputs 106 and priming electrode inputs 102 are derived from a common clock oscillator 108 which produces a clock frequency of 960 KHz. The clock frequency is first divided by six in a divider 110 to produce a reduced frequency of 160 KHz which is divided again by sixteen in a character counter 112. The output frequency from the character counter 112 is 10 KHz which is suitable for scanning the cathodes of the panel 100. This signal is applied to a cathode scanner 114 which may comprise an up-down counter. The scanner 114 is connected to the cathode inputs 106.

At the occurrence of every forty-eighth pulse applied to the cathode scanner a carry pulse is applied to a priming electrode scanner 116 which switches its output from one priming electrode input 102 to another in synchronism with the scanning of the cathodes.

In order to display data in this illustrated example, it will be assumed that the forty-eight cathode rows of the panel 100 are divided into six lines of characters eight rows high. Further it will be assumed that only the middle four of the six lines will be used for the message which will comprise alphanumeric characters of 7×5 format with one cell gap between the characters and rows.

The data source 118 which may be a keyboard or a storage device is connected to a random access memory (RAM) 120 which is capable of storing four pages of message in say ASCII coded form. Each page consisting of four lines of sixteen characters. Thus each page is read at the same time as corresponding columns in each group of four columns are scanned by the cathode pulses. In order to read the information in the RAM 120 in the correct sequence, outputs from the character counter and the cathode scanner are connected to it. The information from the RAM 120 is supplied to a character generator in the form of a read only memory (ROM) 122. The ROM 122 also receives the carry pulse from the cathode scanner 114.

A parallel to serial register 124 is connected to the output of the ROM 122. The register 124 in turn feeds data to a serial to parallel data pump register 126. As only one column of cells in every group is being scanned at any one time, only every fourth bit of data from the register 124 is loaded into the dump register 126. The bits which are to be loaded into the dump register 126 depends upon which of the prime anodes is currently active. Proper synchronization is achieved using a comparator 128 which receives inputs from the priming electrode scanner 116 and from a counter 130 which is connected to the clock generator 108. The output of the comparator 128 comprises a signal of a frequency of 240 KHz.

The data reaches the display panel 100 one row late relative to the logic circuits because the data dump register presents, at the occurrence of a strobe pulse, one row of data to the display anode drivers (not shown) while filling with the data related to the next row. Since a reversing scan is used, the effect of the delay is to displace alternate columns up and down by one. This effect can be corrected for by including a binary adder (not shown) to the circuit which adder alternately adds or subtracts one row.

What is claimed is:

1. A gas discharge display panel comprising:

an apertured plate having two sides, the apertures of which are arranged in a row-column matrix and form gas discharge cells;

spacer means;

first and second cover plates, disposed on opposite sides of the apertured member, one of said plates spaced therefrom by the spacer means, one of said plates being transparent;

a plurality of cathode electrodes disposed between the first cover plate and the apertured member, each cathode electrode being aligned with a respective row of the cells;

a plurality of priming electrodes each being aligned with a respective column of cells;

a plurality of display anodes disposed between the second cover plate and the apertured member and adjacent the cover plate, said display anodes being used for applying display signals as desired to the cells which are to glow brightly compared with the remainder of the cells; and an ionizable gas in said space and in said cells, said gas being in contact with exposed areas of the cathodes, priming electrodes and display anodes;

wherein the gas discharge cells are arranged in repeating groups and each of said groups comprises at least two columns of cells, the display anodes within each group being electrically connected together to a respective single anode input for each group.

2. A panel as claimed in claim 1, wherein the priming electrodes are disposed between the second cover plate and the apertured member.

3. A panel as claimed in claim 2, wherein a display anode is disposed between adjacent columns of cells.

4. A panel as claimed in claim 3, wherein the priming electrodes in corresponding columns of each group are connected together to respective common priming terminals.

5. A panel as claimed in claim 4, wherein each group comprises four columns of cells.

6. A panel as claimed in claim 5, wherein at least one of the groups of cells comprises a keep alive cell.

7. A panel as claimed in claim 6, wherein the cathodes are arranged in repeating groups, said groups comprising at least two rows of cells, the cathodes in corresponding rows of each group being electrically connected to a respective single external connection.

8. A gas discharge display apparatus comprising:

an apertured plate having two sides, the apertures of which are arranged in a row-column matrix and form gas discharge cells;

spacer means;

first and second cover plates, disposed on opposite sides of the apertured member, one of said plates spaced therefrom by spacer means, one of said plates being transparent;

a plurality of cathode electrodes disposed between the first cover plate and the apertured member, each cathode electrode being aligned with a respective row of the cells;

a plurality of priming electrodes each being aligned with a respective column of cells;

a plurality of display anodes disposed between the second cover plate and the apertured member and adjacent the cover plate, said display anodes being used for applying display signals as desired to the cells which are to glow brightly compared with the remainder of the cells; and an ionizable gas in said space and in said cells, said gas being in contact with exposed areas of the cathodes, priming electrodes and display anodes;

wherein the gas discharge cells are arranged in repeating groups and each of said groups comprises at least two columns of cells, the display anodes within each group being electrically connected together to a respective single anode input for each group; further comprising:

a source of cathode pulses, coupled to the cathode electrodes;

a source of priming pulses coupled to the priming electrodes; and means for controlling the sequence of applications of the priming and cathode pulses so that the cells of each group are primed in a desired sequence.

9. A gas discharge display apparatus as claimed in claim 8, wherein the priming sequence is such that each cell is primed by the immediately previous discharge of an adjoining cell in the sequence.

10. A gas discharge display apparatus as claimed in claim 9, wherein the sequence is a closed loop sequence and the last cell to be primed is adjacent the first cell in the sequence to be scanned.

11. A gas discharge display apparatus as claimed in claim 10, wherein each group comprises an even number of columns of cells, and the cells are scanned in a closed loop cycle passing through the cell at one end of a first column and priming each cell, in turn to the other end of the first column, priming an adjacent cell in the same row at the other end of a second column and the remainder of the cells in that column and so on until the cell at the one end of the last column has been primed.

12. A gas discharge display apparatus as claimed in claim 9, wherein the cells in each group are scanned in a sequence beginning at the top of a first column and proceeding cell-by-cell to the bottom of the first column, then continuing at the top of an adjacent column in the group and proceeding cell-by-cell to the bottom of that column and so on.

13. A gas discharge display apparatus as claimed in claim 9, wherein the groups of cells are primed by a ripple through effect and the last cell in one group is used to prime the first cell in an adjacent group.

14. A gas discharge display apparatus as claimed in claim 8, further comprising means for applying a relatively short duration positive pulse to the priming electrode associated with a cell, and means for applying a relatively long duration negative pulse to the cathode electrode associated with a cell;

wherein a cell is primed by simultaneously energizing each of said means associated with said cell, thereby causing the cell to break down.

15. A gas discharge display apparatus as claimed in claim 14, further comprising means for applying a relatively long duration positive display pulse to the anode electrode of a cell at the same time as it is primed, in order to display information by the cell.

16. A gas discharge display panel comprising:

an apertured plate having two sides, the apertures of which are arranged in a row-column matrix and form gas discharge cells, said gas discharge cells being arranged in repeating groups comprising at least two columns of cells;

spacer means;

first and second cover plates, disposed on opposite sides of the apertured member, one of said plates spaced therefrom by the spacer means, one of said plates being transparent;

a plurality of cathode electrodes disposed between the first cover plate and the apertured member, each cathode electrode being aligned with a respective row of the cells;

a plurality of priming electrodes disposed between the second cover plate and the apertured member each being aligned with a respective column of cells, priming electrodes in corresponding columns in each group being electrically connected to respective common priming terminals;

a plurality of display anodes disposed between the second cover plate and the apertured member, said display anodes being used for applying display signals as desired to the cells which are to glow brightly compared with the remainder of the cells, the display anodes within each group being electrically connected together to a respective single anode input for each group; and an ionizable gas in said space and in the cells and in contact with exposed areas of the cathodes, priming electrodes, and display anodes;

wherein each cell in the matrix corresponds one-to-one with an intersection between a cathode electrode, a common priming terminal and an anode input, yet wherein the intersection between any two of these will correspond to more than one cell.

* * * * *